US009074607B2

(12) United States Patent
Lee

(10) Patent No.: US 9,074,607 B2
(45) Date of Patent: Jul. 7, 2015

(54) IMPELLER OF FUEL PUMP FOR VEHICLE

(75) Inventor: Hyuntae Lee, Yeongi-gun (KR)

(73) Assignee: COAVIS (KR)

( * ) Notice: Subject to any disclaimer, the term of this patent is extended or adjusted under 35 U.S.C. 154(b) by 676 days.

(21) Appl. No.: 13/438,400

(22) Filed: Apr. 3, 2012

(65) Prior Publication Data

US 2012/0257980 A1 Oct. 11, 2012

(30) Foreign Application Priority Data

Apr. 5, 2011 (KR) ..... 10-2011-0030990

(51) Int. Cl.
*F04D 29/18* (2006.01)
*F02M 37/10* (2006.01)

(52) U.S. Cl.
CPC ..... *F04D 29/188* (2013.01); *F02M 37/103* (2013.01)

(58) Field of Classification Search
CPC ..... F04D 29/188; F04D 5/002; F04D 29/669; F05B 2250/503; F02M 37/103
USPC ..... 415/55.1, 55.2; 416/196 R, 235, 223 R
See application file for complete search history.

(56) References Cited

U.S. PATENT DOCUMENTS

| | | | | |
|---|---|---|---|---|
| 6,511,283 | B1 * | 1/2003 | Yoshioka | 415/55.1 |
| 2002/0168261 | A1 * | 11/2002 | Honma | 415/55.1 |
| 2003/0118437 | A1 * | 6/2003 | Takami et al. | 415/55.1 |
| 2003/0231952 | A1 * | 12/2003 | Moss | 415/55.1 |
| 2005/0226715 | A1 * | 10/2005 | Inuzuka et al. | 415/58.3 |
| 2007/0077138 | A1 * | 4/2007 | Tsuzuki et al. | 415/55.1 |
| 2007/0104567 | A1 * | 5/2007 | Narisako et al. | 415/55.1 |
| 2008/0056884 | A1 * | 3/2008 | Ikeya et al. | 415/87 |
| 2008/0193297 | A1 * | 8/2008 | Yildirim et al. | 416/223 R |
| 2009/0060709 | A1 * | 3/2009 | Tomomatsu et al. | 415/58.4 |

FOREIGN PATENT DOCUMENTS

| | | |
|---|---|---|
| JP | 3982262 | 7/2007 |
| JP | 2008057377 | 3/2008 |
| KR | 10-2005-0100226 | 10/2005 |
| KR | 1020070098622 | 10/2007 |
| KR | 1020100090612 | 8/2010 |

* cited by examiner

*Primary Examiner* — Nathaniel Wiehe
*Assistant Examiner* — Eldon Brockman
(74) *Attorney, Agent, or Firm* — Cantor Colburn LLP

(57) ABSTRACT

Provided is an impeller of a fuel pump for a vehicle. More particularly, an impeller of a fuel pump for a vehicle, which can improve delivery pressure and a delivery speed of fuel by modifying a shape of an impeller blade that is provided between an upper casing and a lower casing of a fuel pump and is joined to a rotational shaft of a driving motor to deliver fuel by using rotational force at the time of suctioning fuel from a fuel tank and supplying fuel to an engine of an internal combustion engine.

2 Claims, 5 Drawing Sheets

IMPELLER OF FUEL PUMP FOR VEHICLE

CROSS-REFERENCE TO RELATED APPLICATIONS

This application claims priority under 35 U.S.C. §119 to Korean Patent Application No. 10-2011-0030990, filed on Apr. 5, 2011, in the Korean Intellectual Property Office, the disclosure of which is incorporated herein by reference in its entirety.

TECHNICAL FIELD

The following disclosure relates to an impeller of a fuel pump for a vehicle. More particularly, the following disclosure relates to an impeller of a fuel pump for a vehicle, which can improve delivery pressure and a delivery speed of fuel by modifying a shape of an impeller blade that is provided between an upper casing and a lower casing of a fuel pump and is joined to a rotational shaft of a driving motor to deliver fuel by using rotational force at the time of suctioning fuel from a fuel tank and supplying fuel to an engine of an internal combustion engine.

BACKGROUND

In general, a fuel pump of a vehicle is mounted on the inside of a fuel tank of the vehicle and serves to suction fuel and pressure-feed the suctioned fuel to a fuel injection device mounted in an engine.

In addition, the fuel pump for the vehicle is classified into a mechanical fuel pump and an electrical fuel pump and a turbine type fuel pump 10 which is a type of electrical fuel pump is primarily used in an engine using gasoline as fuel.

In the turbine type fuel pump 10, a driving motor 20 is provided in a motor housing 60 of the fuel pump 10, an upper casing 30 and a lower casing 40 are provided on the bottom of the motor housing 60 to be closely attached to each other, and an impeller 50 is interposed therebetween, as shown in FIG. 1.

In addition, the impeller 50 is joined to a rotational shaft 21 of a driving motor 20, such that the impeller 50 is configured to rotate with the driving motor 20.

That is, as the impeller 50 rotates, a pressure difference is generated, and as a result, fuel is suctioned into the impeller 50 and while the pressure of fuel is increased due to a rotation flow generated by continuous rotation of the impeller 50, fuel is ejected.

Therefore, fuel is introduced into a fuel suction opening 41 of the lower casing 40 to flow to a check valve 70 formed in an upper part of the motor housing 60 along an inner part of the motor housing 60 through a fuel ejection opening 31 of the upper casing 30 with the pressure thereof increased through the rotating impeller 50 and supplied to the fuel injection device mounted on the engine of the vehicle.

In this case, the impeller 50 is formed in a disk shape, a plurality of blades 51 are formed on an circumferential surface thereof in an outer direction of the circumferential surface, blade chambers 52 are formed among respective blades 51 to penetrate both surfaces of the impeller 50 as shown in FIG. 2, such that fuel is introduced into the fuel suction opening 41 of the lower casing 40 to generate the rotation flow in a space between the blade chamber 52 and a lower path groove 42 formed in the lower casing 40 and an upper path groove 32 formed in the upper casing 30 as shown in FIG. 3, and a circulation process in which fuel is again introduced into the neighboring blade chamber 52 to generate the rotation flow is repeated. Therefore, kinetic energy generated by the rotation of the impeller 50 is converted into pressure energy of fuel, and as a result, fuel is delivered to the fuel ejection opening 31 of the upper casing 30.

In addition, in the impeller 50 in the related art, a circumference center guider 53 is formed at the center of the circumferential surface along the circumferential surface of the impeller 50 so as to efficiently generate the rotation flow formed in the space between the blade chamber 52 and the lower path groove 42 and the rotation flow generated in the space between the impeller chamber 52 and the upper path groove 32.

However, with a current technological trend in which components in the vehicle are gradually subjected to a light weight, a compact size, and high performance in order to satisfy user's various preferences globally, a study about high performance of even the fuel pump has been required.

In addition, the amount of used pressure of the fuel pump is determined according to a specification of the vehicle and a high pressure is required as a recent trend. Therefore, the fuel pump mounted with the impeller in the related art is limitative in increasing an ejection amount of fuel under high pressure.

SUMMARY

An embodiment of the present invention is directed to providing an impeller of a fuel pump for a vehicle, which can improve delivery pressure and a delivery speed of fuel by forming a blade center guider for efficiently generating a rotation flow of fuel on an impeller blade that is provided between an upper casing and a lower casing of a fuel pump and is joined to a rotational shaft of a driving motor to deliver fuel by using rotational force.

In one general aspect, an impeller of a fuel pump for a vehicle includes: an impeller body having a disk shape, having a circumference center guider that protrudes along the center of a circumferential surface, and having a shaft fixation hole that penetrates at the center into which a rotation shaft of a driving motor is inserted and joined; and a plurality of blades formed on an outer circumferential surface of the impeller body at predetermined intervals in an outer direction of the circumferential surface, wherein each of the plurality of blades has a blade center guider formed on an impeller rotation direction surface in a radial direction and protruding at the center thereof to thereby be connected with the circumference center guider.

Further, the impeller may further include a side ring formed on an outer circumferential surface of the plurality of blades so as to form a blade chamber allowing fuel to be discharged and introduced in the upper and lower parts of the blade, respectively.

An edge at which a surface of the blade center guider and a surface of the blade contact each other and an edge at which the blade center guider and the circumference center guider are connected to each other may be rounded.

Other features and aspects will be apparent from the following detailed description, the drawings, and the claims.

DETAILED DESCRIPTION OF EMBODIMENTS

Figure 1:
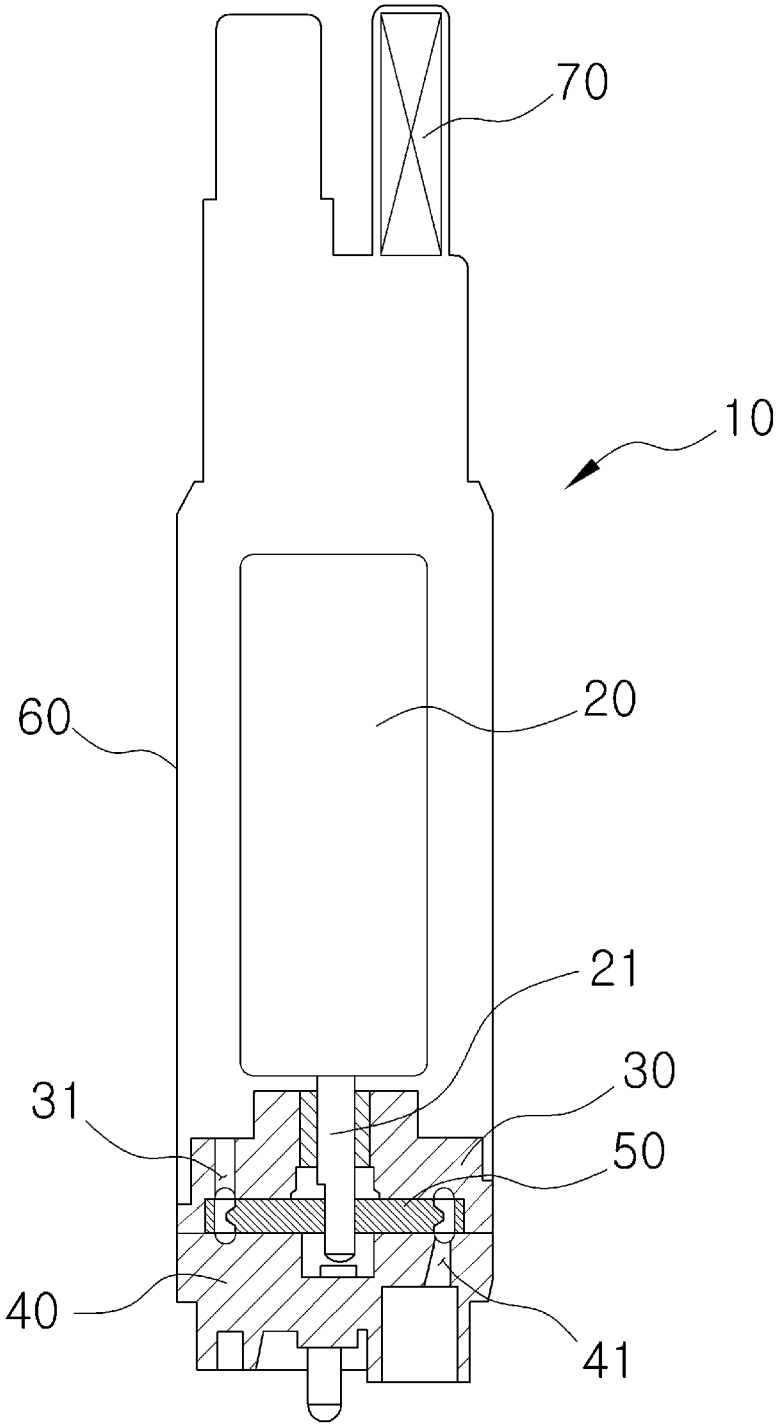
FIG. 1 Prior Art
FIG. 1 is a cross-sectional view illustrating a schematic configuration of a fuel pump for a vehicle in the related art.
Figure 2:
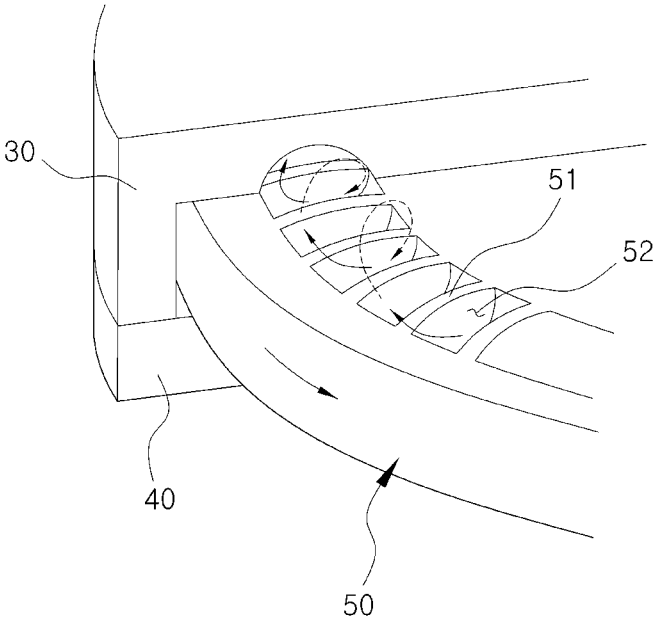
FIG. 2 Prior Art
FIG. 2 is a perspective view illustrating a structure of an impeller in the related art.
Figure 3:
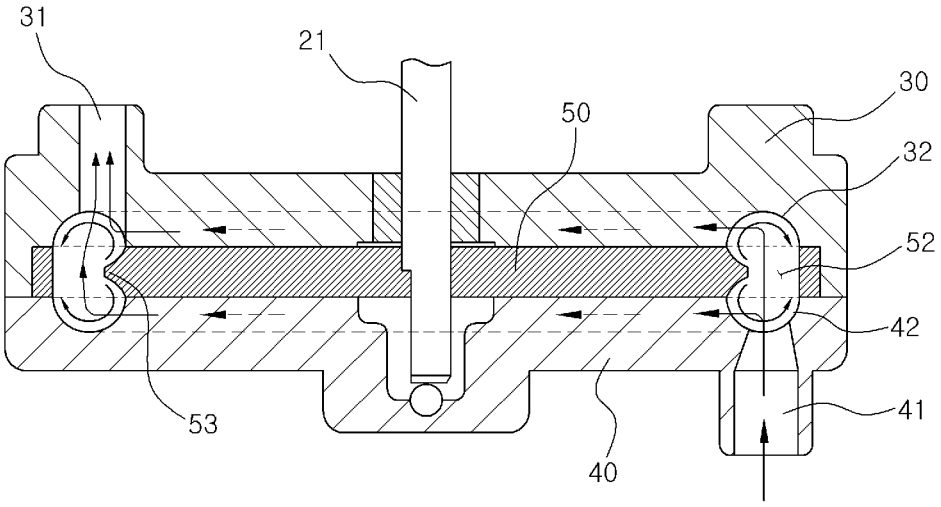
FIG. 3 Prior Art
FIG. 3 is a partial cross-sectional view illustrating the impeller, an upper casing, and a lower casing in the related art.

The advantages, features and aspects of the present invention will become apparent from the following description of the embodiments with reference to the accompanying drawings, which is set forth hereinafter. The present invention may, however, be embodied in different forms and should not be construed as limited to the embodiments set forth herein. Rather, these embodiments are provided so that this disclosure will be thorough and complete, and will fully convey the scope of the present invention to those skilled in the art. The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Hereinafter, exemplary embodiments will be described in detail with reference to the accompanying drawings.

An impeller of a fuel pump for a vehicle according to an exemplary embodiment of the present invention includes: an impeller body 100 having a disk shape, having a circumference center guider 110 that protrudes along the center of a circumferential surface, and having a shaft fixation hole 120 that penetrates at the center into which a rotation shaft of a driving motor is inserted and joined; and a plurality of blades 200 formed on an outer circumferential surface of the impeller body 100 at predetermined intervals in an outer direction of the circumferential surface, wherein each of the plurality of blades 200 has a blade center guider 220 formed on an impeller rotation direction surface in a radial direction and protruding at the center thereof to thereby be connected with the circumference center guider 110.

Hereinafter, the respective components will be described in more detail with reference to the accompanying drawings.

Figure 4:
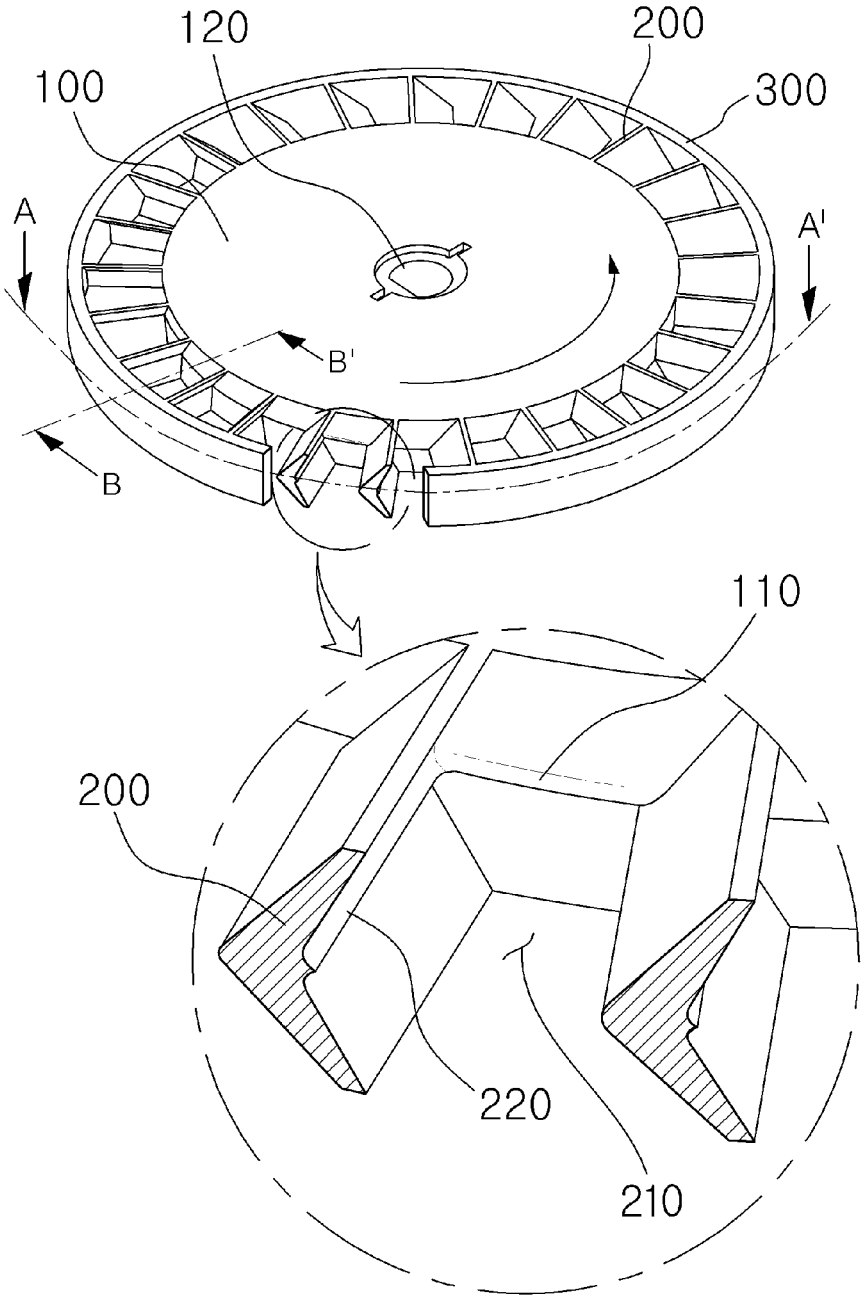
FIG. 4 is a perspective view and a partial enlarged diagram illustrating an impeller of a fuel pump for a vehicle according to an exemplary embodiment.

FIG. 4 is a perspective view and a partial enlarged diagram illustrating an impeller of a fuel pump for a vehicle according to an exemplary embodiment.

In the impeller of a fuel pump for a vehicle according to the exemplary embodiment, a plurality of blades 200 are formed on a circumferential surface of an impeller body 100 that is formed in a disk shape and has a shaft fixation hole 120 formed at the center thereof in an outer direction of the circumferential surface.

In this case, the respective blades 200 are formed in a thickness direction of the impeller body 100 and the plurality of blades 200 are formed at predetermined intervals and blade chambers 210 are formed among the blades 200.

That is, the blade chamber 210 is a space formed between two neighboring blades 200.

In this case, when the impeller rotates, fuel is introduced into the blade chamber 210 to generate a rotation flow between an upper path groove 32 and a lower path groove 42 respectively formed in an upper casing 30 and a lower casing 40 provided in an upper part and a lower part of the impeller to correspond to the position of the blade chamber 210, such that the pressure of fuel increases.

Figure 5:
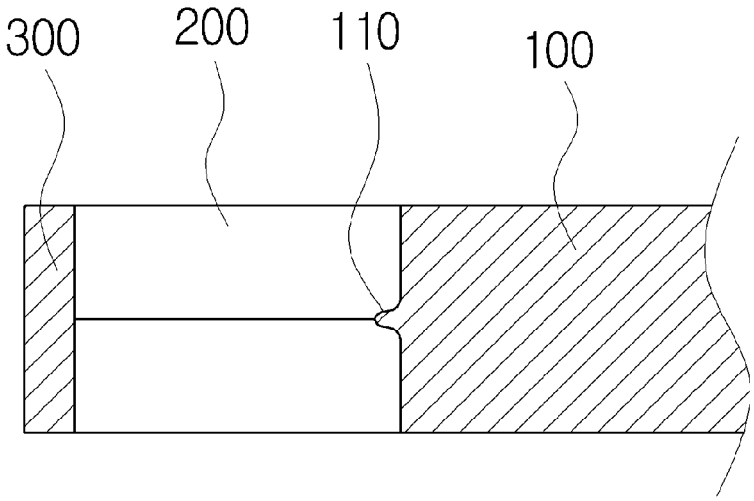
FIG. 5 is a cross-sectional view taken along line B-B' of FIG. 4.

In addition, as shown in FIG. 5, a circumference center guider 110 protrudes along the center of the circumferential surface of the impeller body 100.

The circumference center guider 110 allows the fuel introduced into the blade chamber 210 to more efficiently generate the rotation flow generated in the upper part and the lower part of the blade chamber 210, respectively.

Further, each of the plurality of blades 200 has a blade center guider 220 formed on an impeller rotation direction surface in a radial direction and protruding at the center thereof to thereby be connected with the circumference center guider 110.

Figure 7:
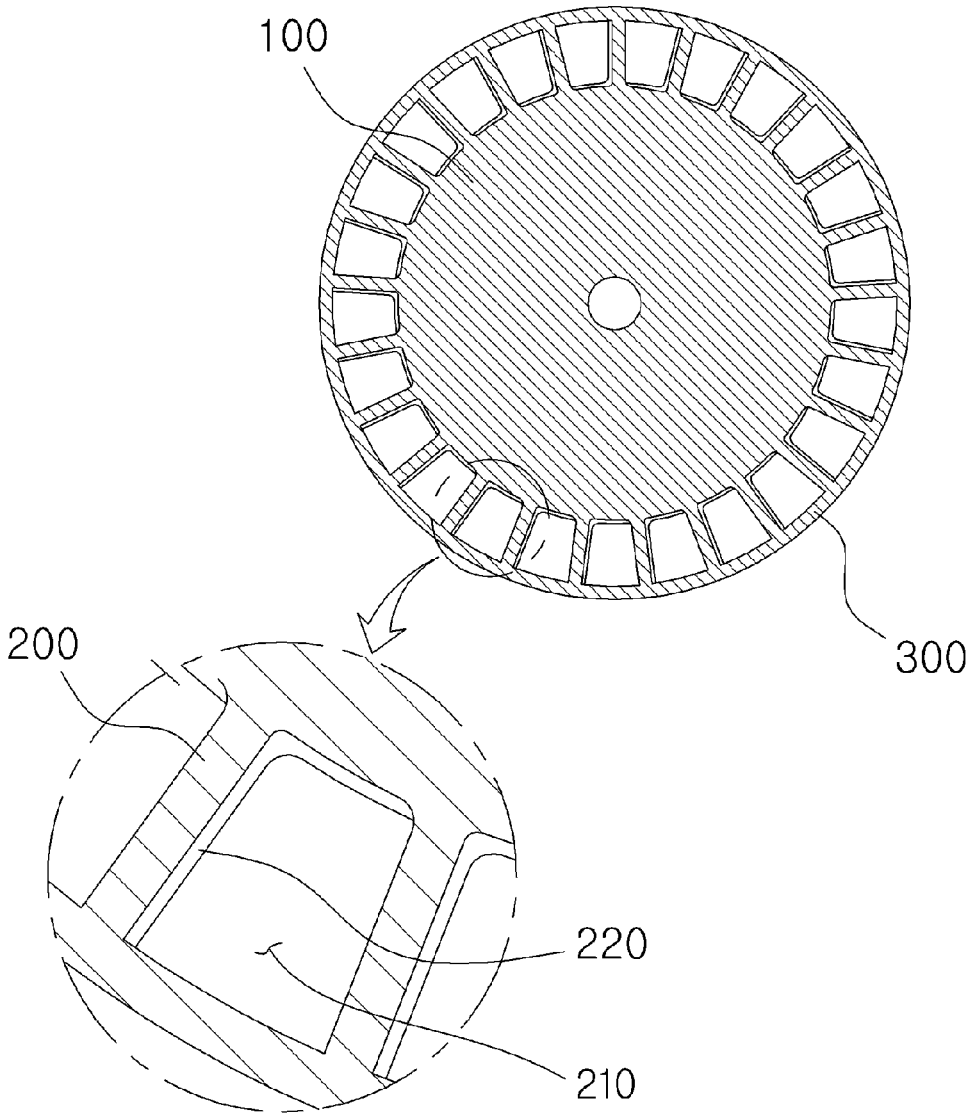
FIG. 7 is a cross-sectional view taken along line A-A' of FIG. 4.

FIG. 7 is a cross-sectional view taken along line A-A' of FIG. 4 and illustrates a cross section cutting an upper part of the blade center guider 220 at the center of the thickness of the impeller.

Further, in the impeller, an edge at which a surface of the blade center guider 220 and a surface of the blade 200 contact each other and an edge at which the blade center guider 220 and the circumference center guider 110 is connected to each other may be rounded as shown in FIG. 7.

Therefore, the rotation flows are efficiently generated in the upper part and the lower part of the blade chamber 210 by the blade 200 and the circumference center guider 110 depending on the rotation of the impeller and the rotation flow is more efficiently generated by the blade center guider 220 to minimize energy loss caused due to turbulence and a change in path, thereby improving a delivery pressure and a delivery speed of fuel as shown in FIG. 5.

Figure 6:
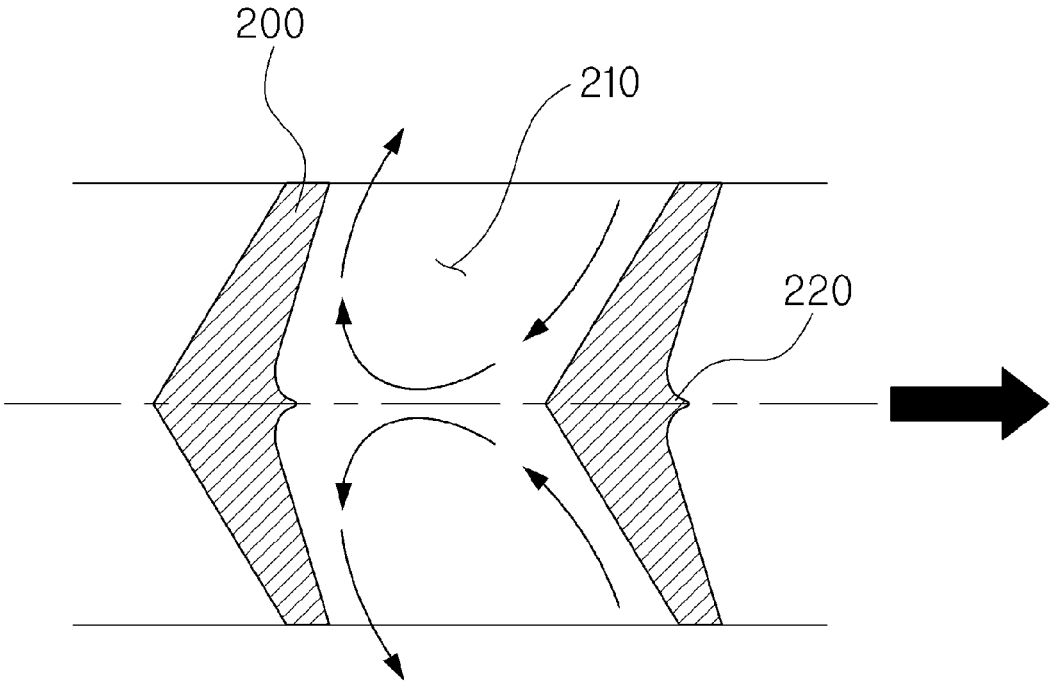
FIG. 6 is a front view illustrating a cross section of the impeller according to the exemplary embodiment.

In addition, the blade 200 has a shape in which the upper part and the lower part of the blade 200 are formed by predetermined slopes to be symmetrical to each other around the circumference center guider 110 as shown in FIG. 4 or 6, but an inside part and an outside part in a circumferential direction of the impeller body 100 of the blade 200 may be bent to form an end and may have various shapes such as a flat plate shape or a round shape.

Further, the blade 200 is formed in the outer direction of the circumferential surface along the circumferential surface of the impeller body 100 and may be in a radial direction at the center of the impeller body 100 and may be formed to have a predetermined angle to the radial direction and may be formed to have a predetermined angle to the radial direction and have a predetermined curvature in a longitudinal direction of the blade.

Further, the plurality of blades 200 are formed on the circumferential surface of the impeller body 100 at predetermined intervals and the intervals among the respective blades 200 may be the same as each other or different from each other.

However, the impeller having the aforementioned configuration is an impeller applied to an open channel type vehicular fuel pump in which the plurality of blades 200 are formed in the impeller body 100, such that the upper part, the lower part, and an outer part of the blade chamber 210 are all opened.

That is, in the open channel type, the fuel introduced into the blade chamber 210 is pushed out in the outer direction of the circumferential surface of the impeller body 110 by the rotation of the impeller to form the rotation flow.

Therefore, the impeller may further include a side ring 300 formed on an outer circumferential surface of the plurality of blades 200 so that fuel is discharged and introduced in the upper and lower parts of the blade 200, respectively and the blade chamber 210 for forming the rotation flow is formed.

That is, the impeller may be applied to a side channel type vehicular fuel pump in which the upper and lower parts of the blade chamber 210 are opened and the outer part of the blade chamber 210 is blocked by the side ring 300, such that the fuel is discharged or introduced only in the upper and lower parts of the blade chamber 210.

Further, a guider protrudes at the center of an inner peripheral surface of the side ring 300 like the circumference center guider 110 formed on the outer peripheral surface of the impeller body 100 to more efficiently generate the rotation flow of the fuel in the blade chamber 210.

According to an embodiment of the present invention, an impeller of a fuel pump for a vehicle can improve a delivery pressure and a delivery speed of fuel by minimizing energy loss caused due to turbulence and a change in path while fuel introduced into a blade chamber of the impeller forms a rotation flow by forming a blade center guider on an impeller blade that is provided between an upper casing and a lower casing of a fuel pump and is joined to a rotational shaft of a driving motor to deliver fuel by using rotational force.

The present invention is not limited to the aforementioned exemplary embodiment and an application range is various and it is apparent that various modifications can be made to those skilled in the art without departing from the spirit of the present invention described in the appended claims.

What is claimed is:

1. An impeller of a fuel pump for a vehicle, comprising:

an impeller body having a disk shape and including a top surface, a bottom surface opposite to the top surface, and an outer circumferential surface in-between;

a circumference center guider formed on the outer circumferential surface, the circumference center guider protruding along a center of the outer circumferential surface, wherein a shaft fixation hole penetrates at a center of the top surface and the bottom surface, and a rotation shaft of a driving motor is inserted into and joined with the shaft fixation hole;

a plurality of blades formed on the outer circumferential surface of the impeller body at predetermined intervals and protruding in a radial direction from the outer circumferential surface; and a blade center guider formed on an impeller rotation direction surface of each of the blades in a radial direction and protruding circumferentially to a peak at the center of the impeller rotation direction surface, an edge at which a surface of the blade center guider and a surface of the blade contact each other being rounded, wherein the circumference center guider and the blade center guider are connected with each other, and an edge at which the blade center guider and the circumference center guider are connected is rounded.

2. The impeller of a fuel pump for a vehicle of claim 1, further comprising a side ring formed along an outer circumferential surface of the plurality of the blades so as to form a blade chamber between two neighboring blades allowing fuel to be discharged and introduced through the blade chamber.

* * * * *